United States Patent [19]

Steele

[11] 4,003,515

[45] Jan. 18, 1977

[54] HANDLE CONTAINER

[75] Inventor: Artie Steele, Hampton, Ga.

[73] Assignee: Union Camp Corporation, Wayne, N.J.

[22] Filed: Jan. 5, 1976

[21] Appl. No.: 646,485

[52] U.S. Cl. ..... 229/52 B; 229/45 R

[51] Int. Cl.[2] ..... B65D 5/02; B65D 5/46

[58] Field of Search ..... 229/52 B, 45

[56] References Cited

UNITED STATES PATENTS

| | | | |
|---|---|---|---|
| 2,186,777 | 1/1940 | Best | 229/45 X |
| 2,331,754 | 10/1943 | Wohlers | 229/45 X |
| 2,459,939 | 1/1949 | Hill et al. | 229/52 B X |
| 2,698,126 | 12/1954 | Belsinger | 229/52 B X |
| 2,916,195 | 12/1959 | Gatward | 229/52 B |
| 3,140,811 | 7/1964 | Hall et al. | 229/52 B X |
| 3,776,108 | 12/1973 | Nock | 229/52 B X |
| 3,924,801 | 12/1975 | Partain | 229/45 R X |

*Primary Examiner*—Davis T. Moorhead
*Attorney, Agent, or Firm*—Kane, Dalsimer, Kane, Sullivan and Kurucz

[57] ABSTRACT

A four-sided container formed from a single piece blank having top closure flaps hinged to the sides of the container, which flaps embody handle members permitting the flaps to be folded into place to form a three-ply closure with a three-ply handle. The container further embodies locking tabs and slots for locking the top closure flaps in place.

4 Claims, 6 Drawing Figures

HANDLE CONTAINER

BACKGROUND OF THE INVENTION

This invention relates to an improvement in containers and, more particularly, to a four-sided handle container, well suited to serve as a carry-on pack for airlines. The container can be formed from a single piece blank which can be set up to provide a three-ply top closure, a three-ply handle and a locking arrangement to lock the top closure in place. The container looks attractive and has the ability to support a substantial load.

Although the prior art discloses many forms of containers with top closures, handles and locking arrangements, the container of the present invention appears to be novel over such disclosures.

SUMMARY OF THE INVENTION

It is an object of the invention to provide a four-sided container which provides a three-ply top closure, a three-ply handle and cooperating tabs and slots to lock the top closure in place.

It is a further object to provide a four-sided container which can be formed from a single piece blank and easily set up into the container herein described.

It is a further object to provide a four-sided container which has a top closure and handle so constructed and combined that a substantial load can be carried by the handle.

It is a further object to provide a container of the type described which is particularly suited as a carry-on pack for airlines.

It is a further object to provide a blank which is simple and economical to manufacture and is efficient and well suited for its intended purpose.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
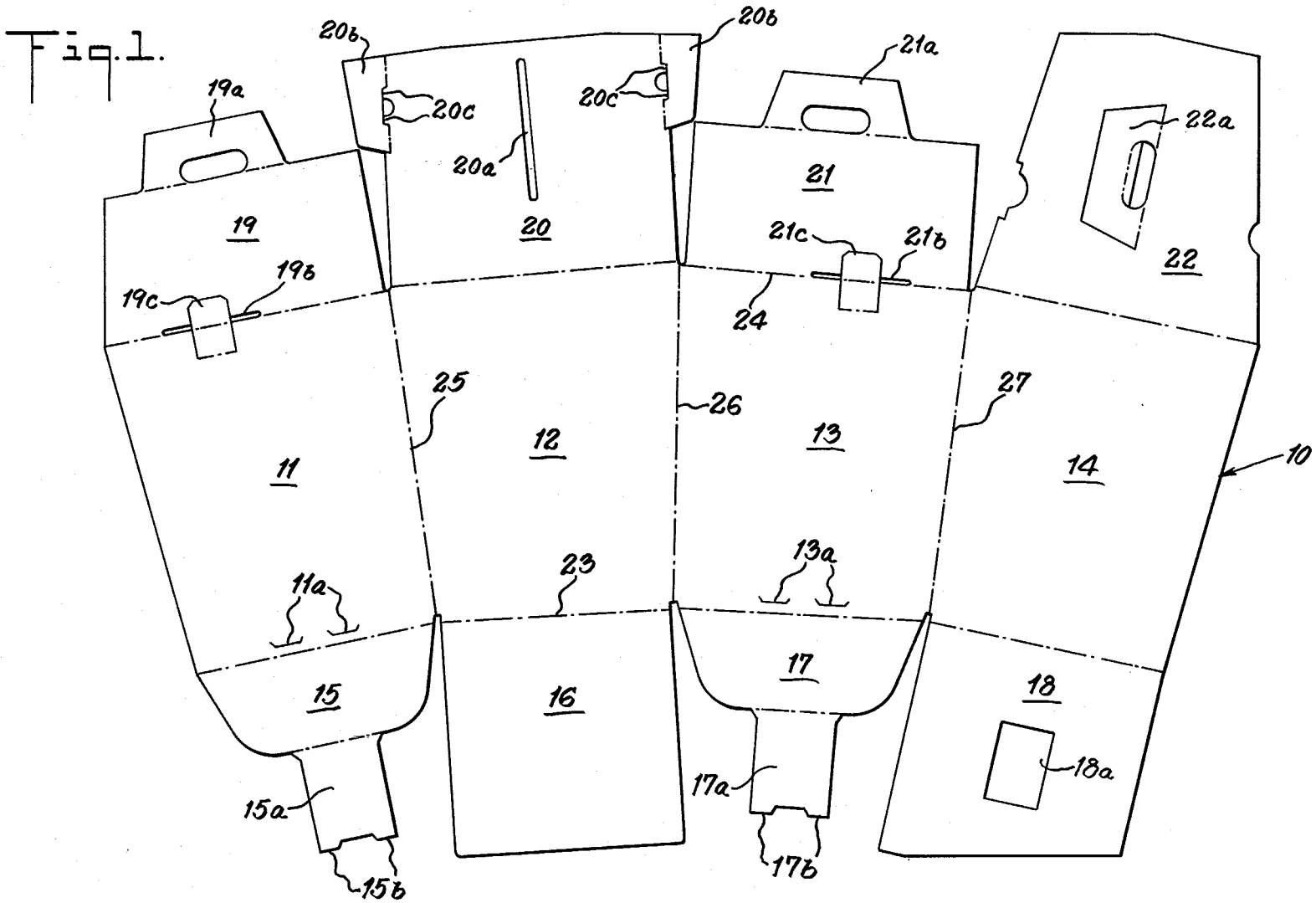
FIG. 1 is a plan view of a blank of the box of the present invention.

Referring to the drawings, there is shown in FIG. 1 a flat-blank 10 of sheet material, such as corrugated board, fiber board, or the like of a weight suitable for the type of carton to be constructed. The blank illustrated will form a container which is tapered from the top to the bottom. However, it will be understood that such container can be square, rectangular, tall, medium or squatty, in which case the shape of the blank will be modified accordingly.

The blank 10 consists of side panels 11, 12, 13 and 14, bottom flaps 15, 16, 17 and 18 and top flaps 19, 20, 21 and 22. The bottom flaps are attached to the side panels along a longitudinal score line 23. The top flaps are attached to the side panels along a longitudinal score line 24. The side panels are attached along score lines 25, 26 and 27.

In setting up the blank into a tube the outer edges of side panels 11 and 14 are joined together and secured with a tape 28. It will be understood that other forms of attachment or joint, such as a glued or stitched flap, can be used.

Figure 2:
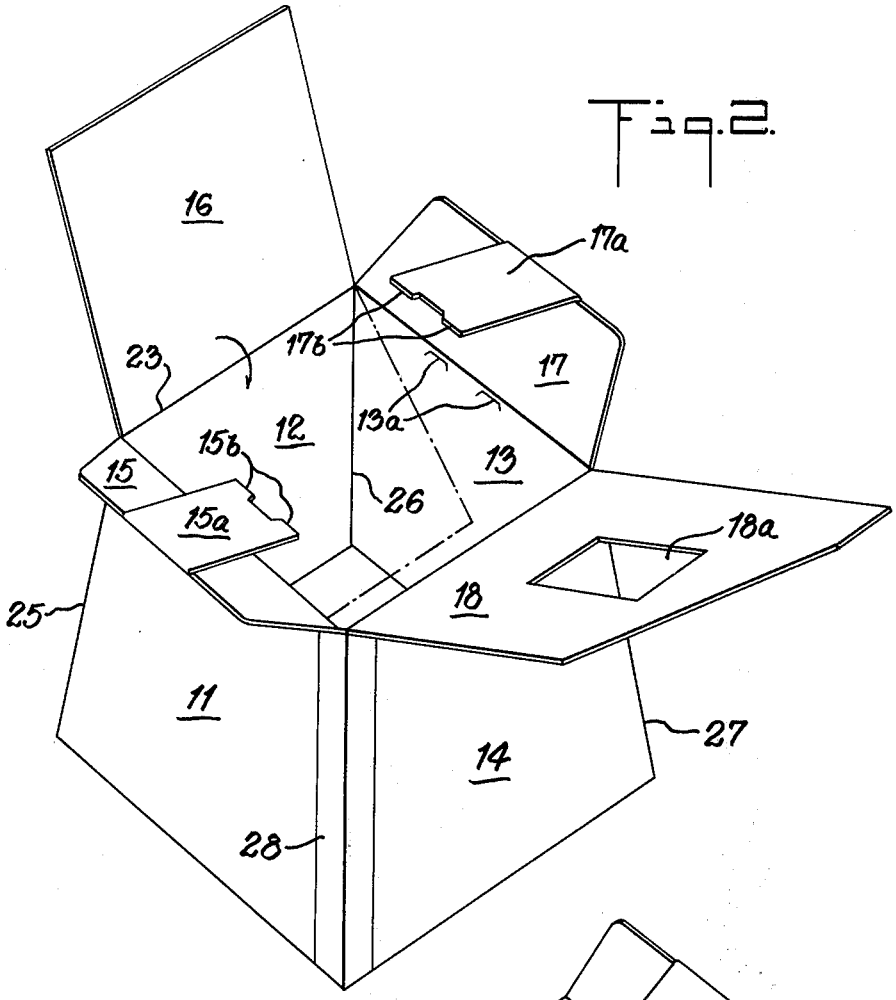
FIGS. 2 and 3 are perspective views of the blank of FIG. 1 showing the blank set up into a tube and the bottom flaps partially folded in place.
Figure 3:
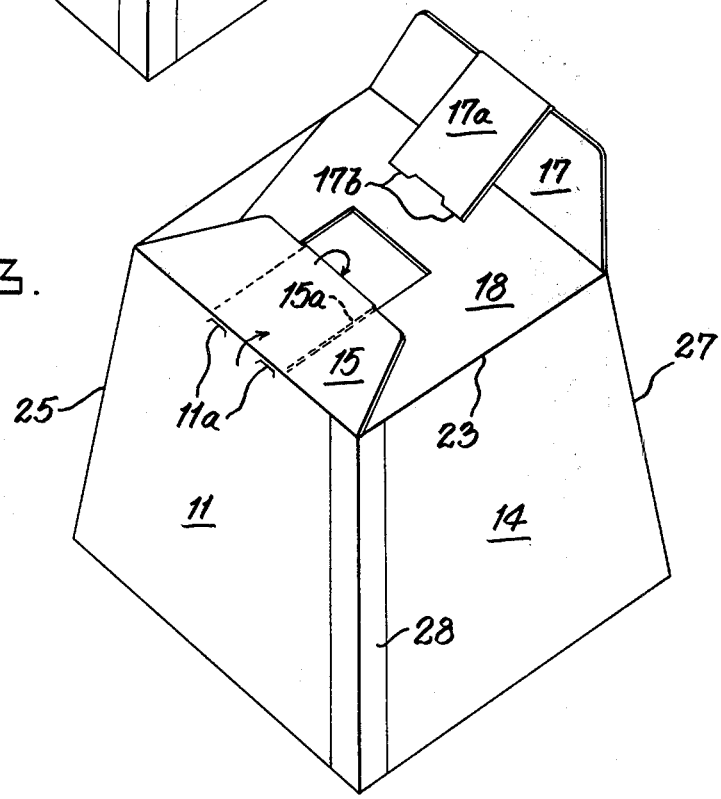

The formation of the bottom for the container is shown in FIGS. 2 and 3, but the bottom formation does not constitute a part of the present invention and can assume various forms. As shown in FIG. 2, flap 16 is first folded inwardly followed by flap 18. The flaps 15 and 17 are then folded inwardly and the tabs 15*a* and 17*a* are inserted into the rectangular opening 18*a* in flap 18 and reverse folded, so that the tabs 15*a* and 17*a* are superimposed on the inside of the flap 18. The tabs are long enough so that the projections 15*b* can be locked into the slots 11*a* and the projections 17*b* into the slits 13*a*. The flap 16 is then pushed downward to lie on top of the reverse folded tabs 15*a* and 17*a* and the flap 18.

Figure 4:
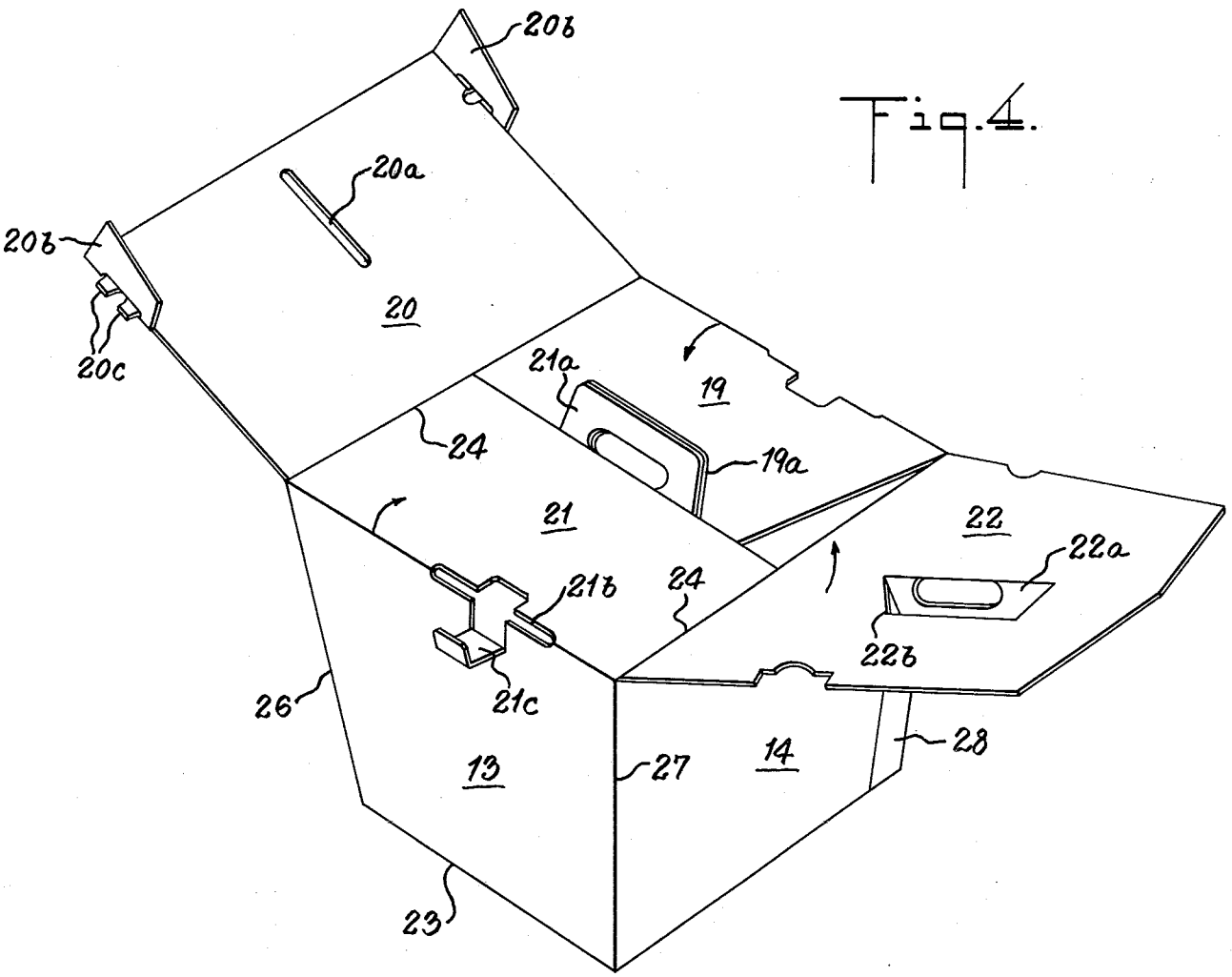
FIG. 4 is a perspective view of a box set up from the blank of FIG. 1 with two opposed top flaps folded into position.
Figure 5:
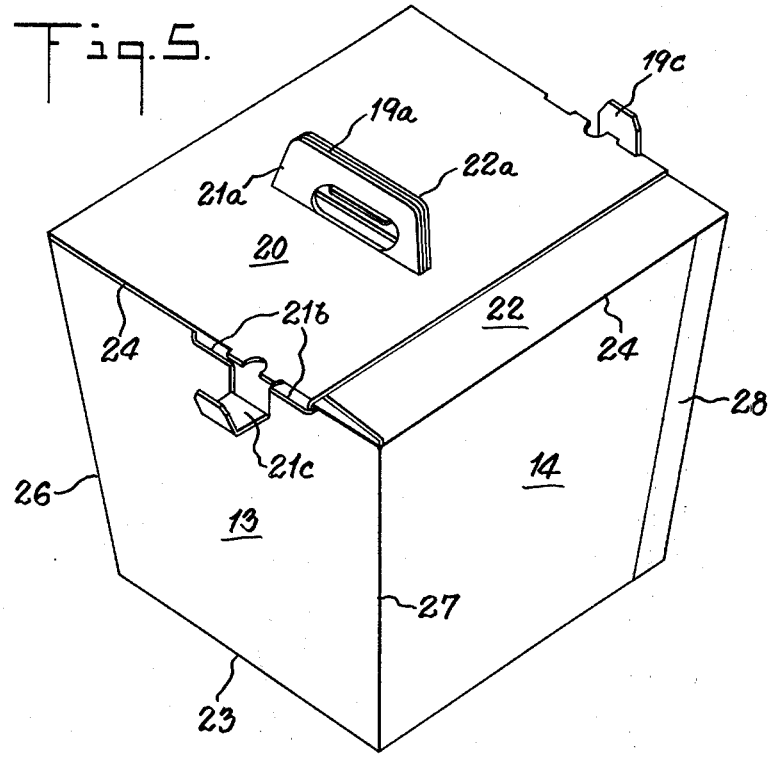
FIG. 5 is a view similar to that of FIG. 4 with all of the top flaps folded into position prior to inserting the locking tabs.
Figure 6:
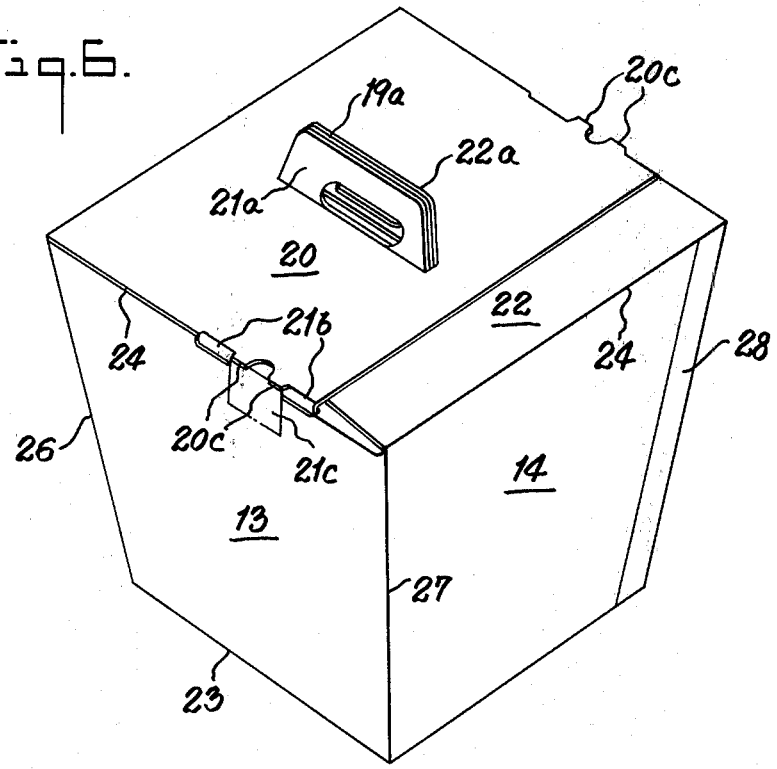
FIG. 6 is a view similar to that of FIG. 4 with all of the top flaps and locking tabs in position to complete the closure.

FIGS. 4, 5 and 6 illustrate the top closure for the container. Flaps 19 and 21 are provided with handle members 19*a* and 21*a* which are hinged to the outer edges of the flaps 19 and 21. Such handle members 19*a* and 21*a* are so positioned that they will align with each other when the flaps 19 and 21 are folded into horizontal position and the handle members are folded upwardly normal to the flaps 19 and 21. If desired, the flaps 19 and 21 can be made of greater length so that they will overlap when folded into horizontal positions, but in such case the handle members will be cut out of the flaps and hinged along lines spaced from the edges of the flaps. This construction is illustrated in FIG. 4 for the flap 22. The handle member 22*a* is cut out of the flap with a hinge line normal to the score line 24. The handle member 22*a* is so positioned that it will align with the handle members 19*a* and 21*a* when the flap 22 is folded into a horizontal position with the handle members 19*a* and 21*a* inserted through the opening 22*b* resulting from cutting the handle member 22*a* out of the flap 22. The flap 20 is then folded to a horizontal position, the handle members 19*a*, 21*a* and 22*a* are inserted through a slot 20*a* in the flap 20, and the flap 20 is superimposed over the flap 22 (FIG. 5).

The top closure flaps are provided with locking means to hold the flaps in locked position. Hinged to each outer corner of the flap 20 is a tab 20*b*. A portion is cut out along the hinge line between the flap 20 and each tab 20*b* to provide projections 20*c* extending outwardly from the hinge line. Along the score line 24 forming the hinge line between the flaps 19 and 21 and the panels 11 and 13 are slots 19*b* and 21*b*. Cut out of the panel 13 and the flap 21 in the central area of the slot 21*b* is a hinged tongue 21*c*. Similarly a tongue 19*c* is formed in the slot 19*b* opposite the tongue 21*c*. When the flap 20 is folded into the horizontal position described above, the tabs 20*b* are inserted into the slots 19*b* and 21*b* (FIG. 5). The tongues 19*c* and 21*c* are inserted into the slots 19*b* and 21*b* to complete the locking of the flaps. It will be seen that the projections 20*c* of the flap 20 serve to guide the tongues 19*c* and 21*c* into the slots 19*b* and 21*b*.

Thus among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A four-sided handle container having a bottom and a top closure, said top closure comprising:

a closure flap secured to each side along a hinge line so that the four said flaps can be folded into overlapping horizontal positions to close the container;

the opposite first and second said flaps having first and second handle members secured respectively to such flaps along first and second parallel hinge lines, the said parallel hinge lines and first and second handle members being positioned so that the handle members can be folded normal to the closed flaps into superimposed relationship;

the third said flap having a third handle member secured to such flap along a third hinge line normal to the said first and second parallel hinge lines of the first and second flaps, said third flap having a first slot adjacent the third hinge line, said third hinge line, first slot and third handle member being positioned so that the third flap can be folded into superimposed relationship over the first and second flaps, the superimposed first and second handle members can be inserted through the said first slot, and the third handle member can be folded normal to the first, second and third flaps with the first, second and third handle members in superimposed relationship;

the fourth said flap having a second slot parallel to the first slot, said second slot being positioned so that the fourth flap can be folded into superimposed relationship over the third flap and the first, second and third superimposed handle members can be inserted through the second slot;

means for securing the said flaps in closed position comprising:

a tab secured to each outer corner of the fourth said flap along a tab hinge line parallel to the said second slot; and tab slots cut out of the first and second said flaps along the hinge lines securing such flaps to the sides, said slots being of a size to receive the said tabs;

the said tabs and tab slots being positioned so that, when the flaps are folded into closed position, the said tabs can be inserted into the said tab slots to lock the flaps into closed position.

2. The container of claim 1 in which the means for securing the said flaps in closed position includes:

tongues cut out of the first and second said flaps and adjacent sides along the hinge lines securing such flaps to the sides; and tongue slots cut out of the said tabs in the center portion of the tab hinge lines, said tongue slots being of a size to receive the said tongues;

the said tongues and tongue slots being positioned so that, when the said tabs have been inserted into the said tab slots, the said tongues can be inserted into the said tongue slots to further lock the flaps into closed position.

3. A one-sheet blank which is cut and scored to define four interconnected side panels, a bottom flap connected by a bottom hinge line to each side panel, and a top flap connected by a top hinge line to each side panel, said top flaps comprising:

each of alternate first and second top flaps having a handle member secured thereto along a handle member hinge line which is parallel to the top hinge line connecting such flap to its side panel, said handle member being positioned so that, when the flaps are folded into closed position, the handle member can be folded normal to the closed flaps into superimposed relationship;

the third top flap having a third handle member secured thereto along a third handle member hinge line normal to the hinge line connecting such flap to its side panel, said third top flap having a first slot adjacent to the third handle member hinge line, said third handle member hinge line, first slot and third handle member being positioned so that, when the flaps are folded into closed position, the third handle member can be folded normal to the first, second and third top flaps with all the handle members in superimposed relationship; and the fourth top flap having a second slot normal to the hinge line connecting such flap to its side panel, said second slot being positioned so that, when the flaps are folded into closed position and all the handle members are folded normal to the flaps, the said fourth top flap can be folded into superimposed relationship over the third top flap with the handle members inserted through the second slot.

4. The blank of claim 3 in which:

a tab is secured to each edge of the said fourth top flap along a tab hinge line parallel to the said second slot, said tabs being spaced from the hinge line securing the fourth said top flap to its side panel;

a tongue cut out of the first and second said top flaps and adjacent sides along the hinge lines securing such flaps to the adjacent sides;

tongue slots cut out of the said tabs in the center portions of the tab hinge lines, said tongue slots being of a size to receive the said tongues;

tab slots cut out of the said first and second top flaps on each side of the said tongue cut outs along the hinge lines securing such flaps to the adjacent sides, the said tab slots being of a size to receive the said tabs;

the said tabs, tongues, tab slots and tongue slots being positioned so that, when the flaps are folded into closed position, the said tabs can be inserted into the said tab slots and the said tongues can be inserted into the said tongue slots to lock the flaps into closed position.

* * * * *